US006668391B1

(12) United States Patent
Lee et al.

(10) Patent No.: US 6,668,391 B1
(45) Date of Patent: Dec. 30, 2003

(54) WATER-SAVING TOILET

(75) Inventors: Hong Suk Lee, Gunpo-shi (KR); Kyeong Won Lee, Shiheung-shi (KR)

(73) Assignee: Korea Item Development Inc. (KR)

( * ) Notice: Subject to any disclaimer, the term of this patent is extended or adjusted under 35 U.S.C. 154(b) by 0 days.

(21) Appl. No.: 10/089,274

(22) PCT Filed: Sep. 4, 2000

(86) PCT No.: PCT/KR00/01006

§ 371 (c)(1),
(2), (4) Date: Mar. 25, 2002

(87) PCT Pub. No.: WO01/34918

PCT Pub. Date: May 17, 2001

(30) Foreign Application Priority Data

Nov. 11, 1999 (KR) ..... 1999/24687

(51) Int. Cl.[7] ..... E03D 11/10
(52) U.S. Cl. ..... 4/434; 4/420; 4/421; 4/337
(58) Field of Search ..... 4/434, 420, 421, 4/316, 337, 422, 431; 248/125.2, 332

(56) References Cited

U.S. PATENT DOCUMENTS

| | | | | |
|---|---|---|---|---|
| 393,109 A | * | 11/1888 | Hubert | 4/329 |
| 2,817,092 A | * | 12/1957 | Hahn | 4/323 |
| 5,257,422 A | * | 11/1993 | Ruegg | 4/307 |
| 5,446,928 A | * | 9/1995 | Daniels | 4/434 |

FOREIGN PATENT DOCUMENTS

| | | |
|---|---|---|
| JP | 6-46070 | 6/1994 |
| KR | 95-3576 | 2/1995 |
| KR | 97-9870 | 3/1997 |

OTHER PUBLICATIONS

English Abstracts of all of the above foreign applications are included on the front of each reference.

* cited by examiner

*Primary Examiner*—Gregory Huson
*Assistant Examiner*—Azy Kokabi
(74) *Attorney, Agent, or Firm*—Marger Johnson & McCollom, P.C.

(57) ABSTRACT

A water-saving toilet is disclosed. The water-saving toilet comprises: a toilet main body having an inlet orifice for introducing water from a water supply tube disposed at the outside of the main body, a toilet bowl for containing outside waste material and water supplied from the inlet orifice, and an outlet orifice for discharging the waster material and water in the toilet bowl; a discharge tube, one end of which is connected to the outlet orifice of the main body and the other end of which is connected to an outside outlet to serve as a discharge passage of waste material and water, including a curved portion which is movable up and down; means for moving the curved portion of the discharge tube up and down. With the water saving toilet, the waste material can be removed out of the toilet bowl with a minimum amount of water by the movement of the discharge tube. In addition, silent flushing operation is possible since open/close operation according to a siphon principle is not employed.

8 Claims, 3 Drawing Sheets

WATER-SAVING TOILET

TECHNICAL FIELD

The present invention relates to a water-saving toilet characterized by a flexible plumbing tube, which resulted in significant saving of flushing water.

BACKGROUND ART

Due to the shortage of water resource, the problem of wasting water has become a serious public concern. Especially, water used in toilet flushing is a huge waste of resources since the clean water produced by extensive purification steps goes right into sewers in this process.

FIG. 1 is a schematic diagram of a conventional toilet fixture. Referring to FIG. 1, a toilet comprises a toilet main body 10 having a water inlet orifice 11 on the top and a water outlet orifice 12 at the bottom, a toilet bowl 13 from which water and waste materials are discharged and is connected to the inlet orifice 11 and the outlet orifice 12, the first discharge tube 14 the bottom of which makes a direct contact with the outlet orifice 12 and the top of which is positioned higher than the outlet orifice 12, and the second discharge tube 15 which follows the first tube and guides the waste materials downward to drainage; a water reservoir tank 20 which has an inlet orifice 11 connected to an outlet orifice 22 of the toilet main body 10; a trip lever 40 which presents at the outside of the water reservoir tank 20 and can move up and down; a packing 31 which controls the opening and closing of the tank outlet orifice 22 by connecting to the lever 40; and a trap 50 disposed at the first discharge tube 14 of the toilet main body 10.

When the outlet orifice 22 in the reservoir tank 20 is opened up by pulling down the trip lever 40, water from the reservoir tank 20 rapidly flows into the toilet main body 10. The elevated water level in the toilet main body 10 forces the water to exit through the trap 50 by the siphon effect.

The conventional toilets based on the aforementioned water-pressure dependent siphon mechanism consume about 7~13 L of water in an operation and in addition create a noisy flushing sound due to the presence of a trap.

DISCLOSURE OF THE INVENTION

Therefore, the objective of the present invention is to provide a water-saving toilet which does not employ a siphon principle and a trap, thus saving the amount of flushing water.

To achieve the objective, the water-saving toilet of the present invention comprises a toilet main body having an inlet orifice for introducing water through an external water supply tube, a toilet bowl that collects waste materials and receives the flushing water from the inlet orifice, and an outlet orifice for discharging the waste materials and water in the toilet bowl; a discharge tube one end of which is connected to the outlet orifice of the toilet main body and the other end of which is connected to an outside outlet to serve as a discharge passage of the waste materials and water, including a vertically movable curved portion; and means for moving the curved portion of the discharge tube up and down.

Preferably, the discharge tube is made of a flexible material.

BEST MODE FOR CARRYING OUT THE INVENTION

Figure 1:
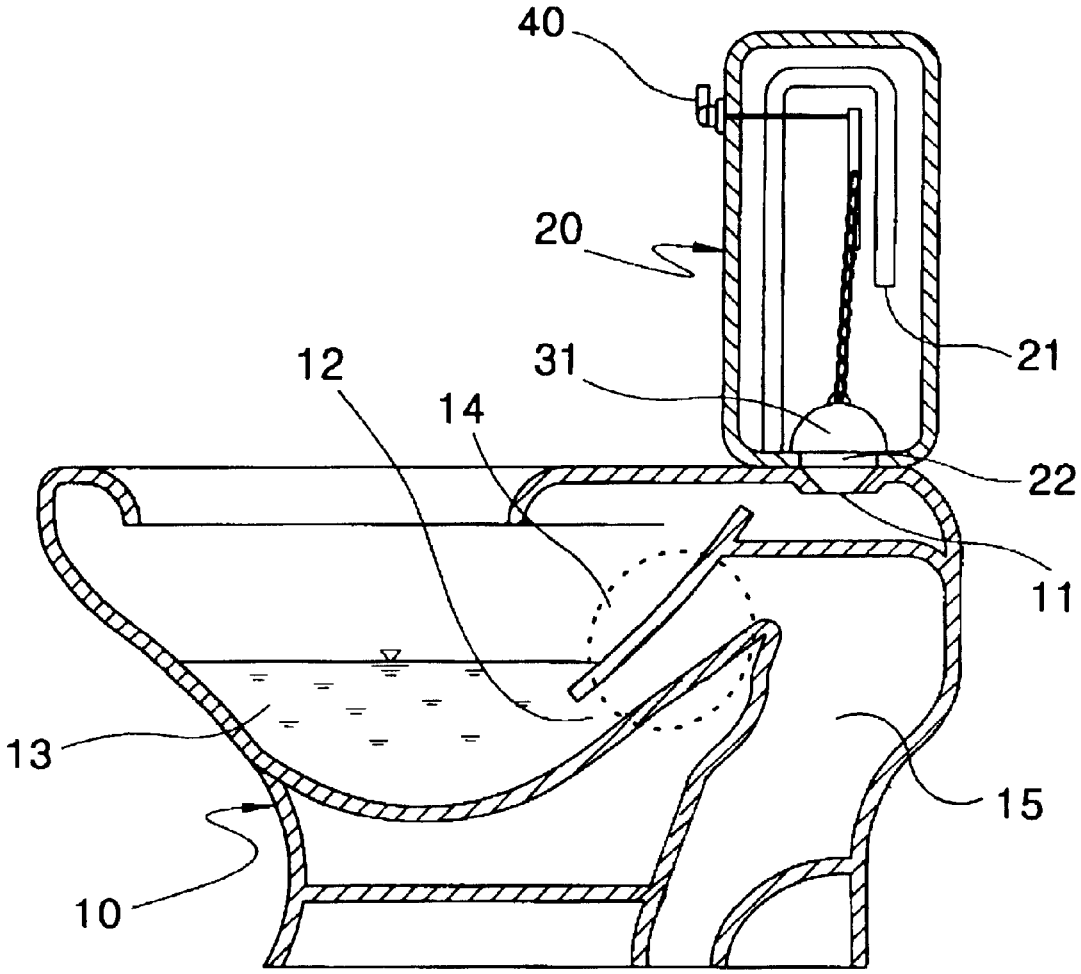
FIG. 1 (Prior Art)
FIG. 1 is a schematic diagram of a conventional toilet.
Figure 2:
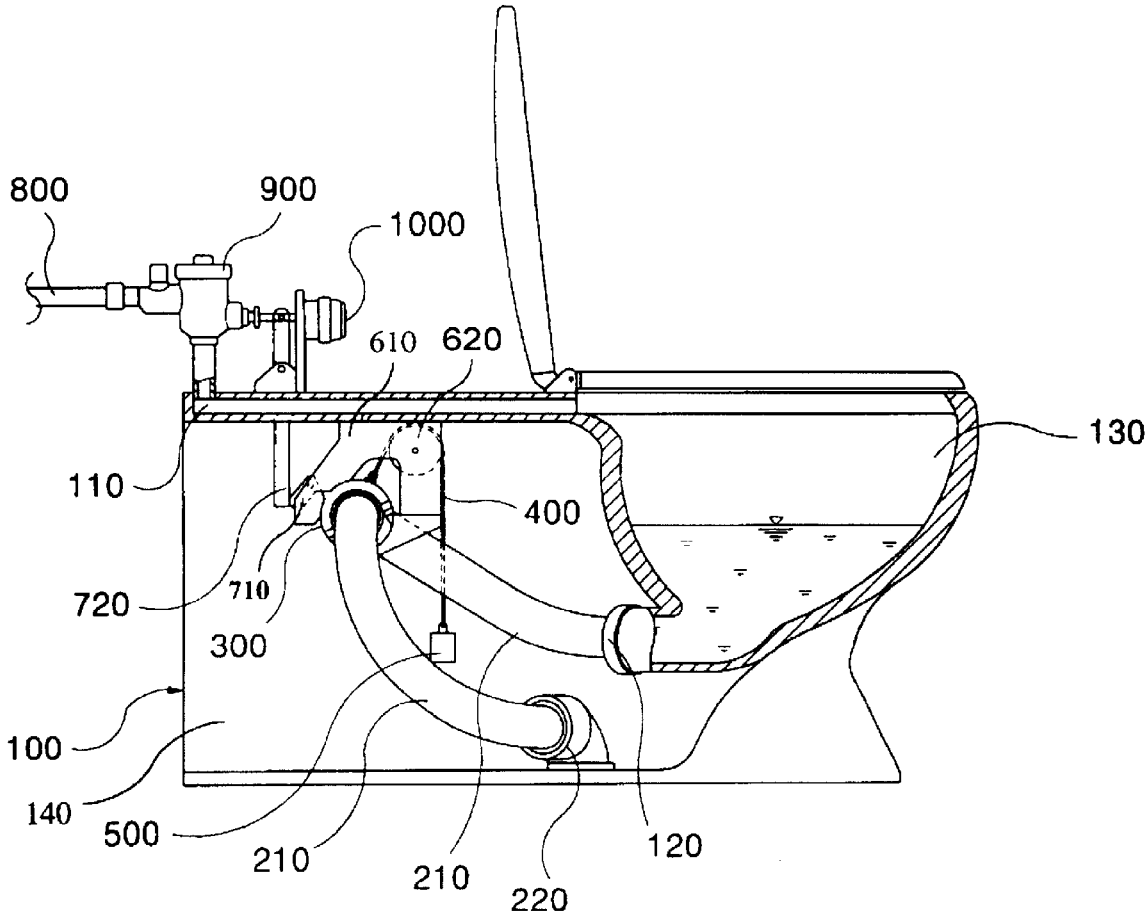
FIG. 2 is a schematic diagram of a water-saving toilet according to the present invention.
Figure 3:
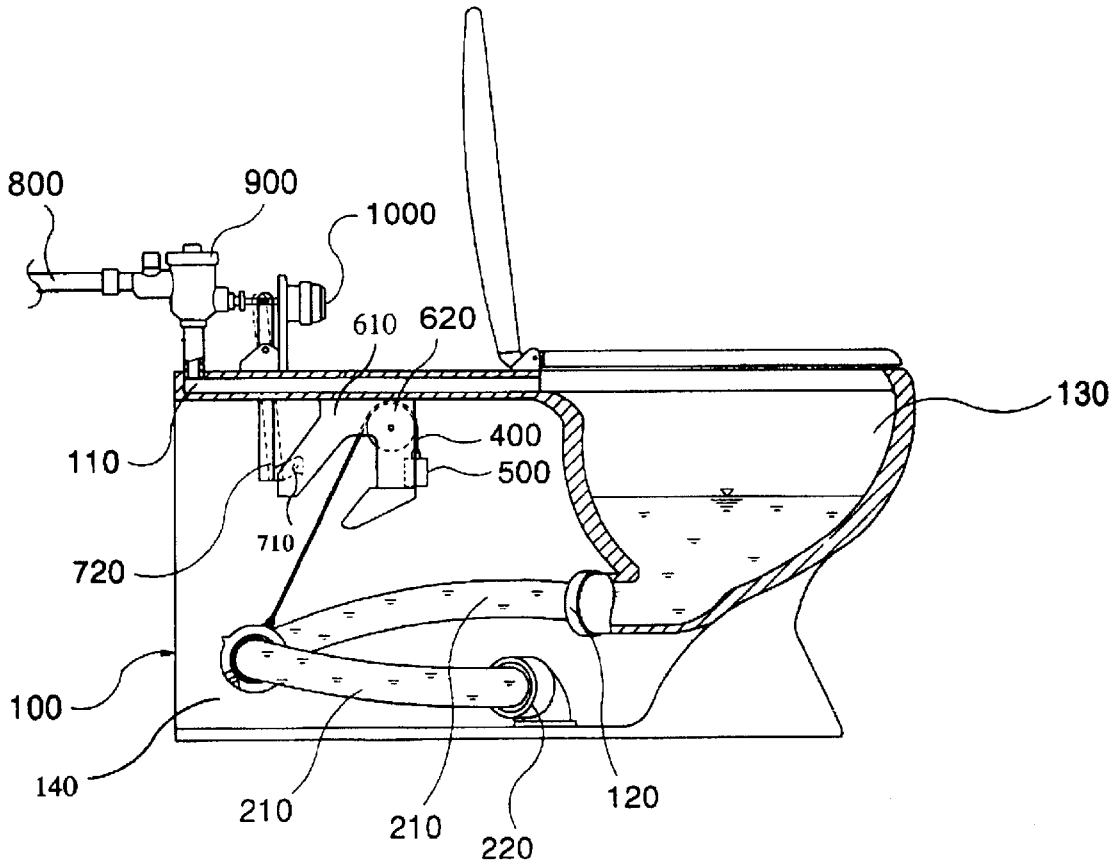
FIG. 3 is a schematic diagram of a water-saving toilet of the FIG. 2 in flushing operation.

Examples of the present invention are described below by referring the attached drawings. FIG. 2 is a schematic diagram of a water-saving toilet according to the present invention. FIG. 3 is a schematic diagram of a water-saving toilet of FIG. 2 in flushing operation.

Referring to FIG. 2 and FIG. 3, water flows into the toilet main body 100 after opening of a flush switching valve 900 which comprises an inlet orifice, an outlet orifice and a working unit, and is installed in the flush water conduit 800. For an external operation of the switching valve 900, a button 1000 connected to the working unit of the switching valve is attached to the toilet main body. Pressing the button 1000 triggers the opening of the switching valve 900, which is set to remain open until 2.5~4 L of water is released and then returns to the closed position.

The toilet main body 100 comprises an inlet orifice 110 which connects the flush water conduit 800 for water introduction, a toilet bowl 130 which receives water from the conduit 800 and collects waste materials, and an outlet orifice 120 located below the toilet bowl 130. The outlet orifice 120 of the toilet main body 100 is a discharge passage for water and waste materials in the toilet bowl 130, and is connected to the discharge tube 210. The inlet 110 and the outlet 120 orifices of the toilet main body 100 are specifically set to allow the discharge volume to the outlet orifice 120 to be larger than the volume of the flush water influx from the inlet orifice 110. By default, the toilet bowl 130 is filled with 2~3 L of water to prevent the offensive odor from coming out of the outlet orifice 120.

One end of the discharge tube 210 connects the outlet orifice 120 of the toilet main body 100 and the other end connects to a drainage tube 220 running under the toilet main body 100. The discharge tube 210 is made of a flexible material and is curved so that its center of gravity can be shifted vertically upon the application of an external force.

There is a space 140 in the toilet main body 100 except for the inlet orifice 110, the outlet orifice 120 and the toilet bowl 130, and means for a vertical moving of the discharge tube 210 is installed in the space 140. The means comprises a hooked clasp 300 which has projections on its periphery and is attached to the center of the discharge tube 210, a spindle 610 placed above the water level of the toilet bowl 130 when there is 2~3 L of water and a pulley 620 which is installed to the spindle 610, a wire 400 hanging around the pulley 610 by being connected to the clasp 300, and a weight 500 attached to the other end of the wire 400. The weight 500 is lighter than the weight of the discharge tube 210 plus water introduced in the discharge tube 120 but is heavier than the empty discharge tube 210 alone.

Or, a spring can be used as an alternative to the pulley-based moving means in triggering the vertical shift of the discharge tube's 210 gravity center. In this case, one end of the spring is connected to the clasp 300 installed at the center of the discharge tube 210, and the other end is attached to the toilet main body 100. The spring should be connected to the clasp 300 in such a way that one end of the spring connected to the clasp 300 is placed at a point higher than the default water level (2~3 L) of the toilet bowl 130 when the spring is contracted. The elastic force of the spring need to be able to withhold the weight of the empty discharge tube 210, but not the weight of the tube 210 filled with water.

A latch 710 is placed on the spindle 610. The latch 710 is hooked to a projection of the clasp 300 so that the discharge tube 210 is kept at a fixed position when its center of gravity is raised at or above the default water level (2~3 L) of the toilet bowl 130, resulting in the difference in weight between the weight 600 and the discharge tube 210.

At this point, the latch 710 tends to move away from the point where the discharge tube 210 is locked due to the weight of the discharge tube 210 imposed on the latch 710, and as a result the discharge tube 210 will be released from the latch 710. In order to prevent this from happening, a supporting rod 720 is installed to the latch 710. When the discharge tube 210 needs to be freed from the latch 710 during the flush operation, an external force is applied to the support 720, which will cause the supporting rod 720 to move away from the point of the discharge tube attachment, making the latch 710 rotate to release the discharge tube 210. The supporting rod 720 is connected to the flush switching button 1000 to ensure that the release of the discharge tube 210 from the latch 710 is coordinated with the opening of the flush switching valve 900.

When the flush button 1000 on the toilet main body 100 is pressed, the latch 710 rotates to release the discharge tube 210 from the latch 710, and then the center of gravity of the discharge tube 210 is positioned below the outlet orifice 120 of the toilet main body 100. As a result, water and waste materials in the bowl tank 130 are discharge by passing through the discharge tube 210 and the drainage tube 220. Concurrently, flush water enters the toilet main body 100 through the flush valve 900. The first 0.3~1 L portion of water is used to rinse the toilet bowl 100 and the outlet orifice 120 of the toilet main body before exiting into the discharge tube 210. Since the amount of the water exiting the toilet main body 100 is less than that of coming into the toilet main body 100, the discharge tube 210 is being unfilled, and the tube 210 becomes lighter than the weight 500 pulling the tube 210 through the pulley wire 400 attached to the clasp 300. The center of gravity of the discharge tube 210 moves upward and finally reaches the latch. Then the discharge tube 210 is locked in secure position with the latch 710. This allows water to fill in the toilet bowl 130. When the water level in the bowl tank 130 rises back to the default level (2~3 L), the flush switching valve 900 closes up again.

INDUSTRIAL APPLICABILITY

As stated above, the water-saving toilet according to the present invention significantly reduces the amount of the water needed to flush a toilet, as compared with the conventional toilets. This was essentially achieved by a dynamic positioning of the waste discharge tube controlled by the balance between the weight of the discharge tube and an externally implemented weight. It also provides a much quieter operation due to the elimination of a siphon-based trap in the toilet bowl.

Furthermore, unlike the many currently available water-saving toilet models, it does not require an additional power source to assist the flushing operation, thus saving the energy.

Although the present invention has been illustrated with reference to embodiments of the present invention, various modifications are possible within the scope of the present invention by a person skilled in the art. Therefore, the scope of the present invention should be defined not by the illustrated embodiments but by the attached claims.

What is claimed is:

1. A water-saving toilet comprising:

a toilet main body with an inlet orifice introducing water from the external flush water conduit, a toilet bowl receiving the water from the inlet orifice and collecting waste materials, and an outlet orifice to which water and waste materials in the toilet bowl are discharged;

a vertically movable discharge tube a portion of which is curved, one end of the discharge tube is connected to the outlet orifice of the above toilet body, the other end is connected to an externally installed drainage tube, and functioning as a discharge passage for water and waste materials in the bowl tank; and means for moving the curved portion of the discharge tube up and down, wherein the means for moving the curved portion of the discharge tube comprises a clasp attached to the discharge tube, a pulley placed at a higher level than the outlet orifice of the toilet main body, a wire one end of which is attached to the clasp, and a weight which is attached to the other end of the wire, and weighs heavier than the empty discharge tube but lighter than the discharge tube filled with water, thus enabling the vertical shift of the portion of the discharged tube by a weight difference.

2. The water-saving toilet according to claim 1, wherein there is a projection in the clasp.

3. The water-saving toilet according to claim 2, further comprising a latch locking into the projection on the clasp and fixing position of the discharge tube when a designated portion of the discharge tube is elevated above the outlet orifice of the toilet main body; and a supporting rod which is connected to the latch and keeps the latch from rotating in order to prevent the latch from releasing the locked discharge tube by the rotation of the latch.

4. The water-saving toilet according to claim 1, wherein the discharge tube is made of a flexible material.

5. The water-saving toilet according to claim 1, further comprising a flush switching valve which comprises an inlet orifice, a discharge tube and a working unit which controls the discharge orifice, and is installed in the water conduit.

6. The water-saving toilet according to claim 5, wherein the supporting rod and the button are connected to each other in order to facilitate the coordination of the supporting rod and the button.

7. The water-saving toilet according to claim 1, further comprising a button that is installed outside the flush switching valve and controls the valve operation by being connected to the working unit of the flush switching valve.

8. The water-saving toilet according to claim 7, wherein the supporting rod and the button are connected to each other in order to facilitate the coordination of the supporting rod and the button.

* * * * *